US006655452B2

(12) United States Patent
Zillinger

(10) Patent No.: US 6,655,452 B2
(45) Date of Patent: Dec. 2, 2003

(54) DOWNHOLE GAUGE CARRIER APPARATUS

(76) Inventor: Fred Zillinger, P.o. Box 9042, Sylvan Lake, Alberta (CA), T4S IS6

( * ) Notice: Subject to any disclaimer, the term of this patent is extended or adjusted under 35 U.S.C. 154(b) by 124 days.

(21) Appl. No.: 09/967,359

(22) Filed: Sep. 28, 2001

(65) Prior Publication Data

US 2003/0062156 A1 Apr. 3, 2003

(30) Foreign Application Priority Data

Sep. 21, 2001 (CA) ..... 2357539

(51) Int. Cl.[7] ..... E21B 47/01; E21B 47/06

(52) U.S. Cl. ..... 166/66; 166/242.1; 166/113; 175/48; 175/40; 73/152.55; 73/152.51

(58) Field of Search ..... 166/66, 113, 242.1; 175/48, 40, 320; 73/152.55, 152.54, 152.52, 152.53, 152.51, 431

(56) References Cited

U.S. PATENT DOCUMENTS

| | | | | |
|---|---|---|---|---|
| 3,225,830 A | | 12/1965 | Livingston | |
| 3,939,705 A | | 2/1976 | Glotin et al. | |
| 4,190,124 A | * | 2/1980 | Terry | 175/406 |
| 4,200,297 A | * | 4/1980 | Tricon | 277/337 |
| 4,388,969 A | * | 6/1983 | Marshall et al. | 166/242.5 |
| 4,428,626 A | * | 1/1984 | Blau et al. | 175/325.4 |
| 4,492,865 A | * | 1/1985 | Murphy et al. | 250/265 |
| 4,570,481 A | | 2/1986 | McLaurin | |
| 4,593,771 A | | 6/1986 | Comeau | |
| 4,603,578 A | * | 8/1986 | Stoltz | 73/152.54 |
| 4,628,995 A | | 12/1986 | Young et al. | |
| 4,662,461 A | * | 5/1987 | Garrett | 175/325.4 |
| 4,711,123 A | | 12/1987 | Christensen | |
| 4,747,304 A | | 5/1988 | King | |
| 4,817,710 A | * | 4/1989 | Edwards et al. | 166/242.7 |
| 4,979,563 A | * | 12/1990 | Patel | 73/706 |
| 4,986,350 A | * | 1/1991 | Czernichow | 166/65.1 |
| 5,251,708 A | * | 10/1993 | Perry et al. | 175/41 |
| 5,320,169 A | | 6/1994 | Delatorre | |
| 5,327,971 A | * | 7/1994 | Garbutt et al. | 166/250.07 |
| 6,209,632 B1 | * | 4/2001 | Holbert et al. | 166/65.1 |
| 6,523,609 B1 | * | 2/2003 | Miszewski | 166/66 |

FOREIGN PATENT DOCUMENTS

| | | |
|---|---|---|
| CA | 1201057 | 2/1986 |
| GB | 2354022 | 3/2001 |
| WO | WO 87/02095 | 4/1987 |

OTHER PUBLICATIONS

Halliburton Energy Services, Inc. materials entitled "Instream Gauge Carrier", dated 1997, 4 pages.
Halliburton Energy Services, Inc. materials entitled "SG–15 Gauge Carrier", dated 1998, 4 pages.
Micro–Smart Systems, Inc. materials entitled "4–Memory Gauge Bundle Carrier", dated 1998, 4 pages.
The Expro Group materials entitled "Subsurface Systems—gauge carrier", dated Feb.–Apr. 2000, 2 pages.

* cited by examiner

*Primary Examiner*—David Bagnell
*Assistant Examiner*—Shane Bomar
(74) *Attorney, Agent, or Firm*—Terrence N. Kuhaschuk; Rodman & Rodman

(57) ABSTRACT

A carrier apparatus for connection with a pipe string for use in transporting at least one gauge downhole through a borehole. The apparatus includes a tubular body for connection with the pipe string having a bore for conducting a fluid therethrough and an outer surface, wherein the outer surface has at least one longitudinal recess formed therein. Further, at least one insert defining an internal chamber for receiving a gauge is mounted with the body such that at least a portion of the insert is receivable within the recess for engagement therewith. The apparatus also includes an interlocking interface comprised of the engagement between the insert and the recess, wherein the interlocking interface is configured such that the insert inhibits radial expansion of the body adjacent the recess. Finally, at least one passage provides fluid communication between the gauge and one of the bore of the body and the borehole.

24 Claims, 11 Drawing Sheets

DOWNHOLE GAUGE CARRIER APPARATUS

FIELD OF INVENTION

The present invention relates to a carrier apparatus for connection with a pipe string for use in transporting or conveying at least one gauge downhole through a borehole.

BACKGROUND OF INVENTION

In both the drilling and production of boreholes, it is often necessary to insert or introduce gauges or test instruments into the borehole in order to obtain information regarding borehole parameters or other downhole conditions such as temperature, pressure or flow rate. In this regard, carrier tools or apparatuses, commonly referred to as bundle carriers, are used for transporting or conveying the gauges or instrument bundles downhole in the borehole. Generally, the carrier apparatus is comprised of an elongate tubular section having a bore therethrough and which is threaded at its upper and lower ends for connection into the pipe string, such as a drill string or production string. As a result, fluids such as drilling or productions fluids flow through the pipe string by passing through the bore of the carrier apparatus.

One form of carrier apparatus is comprised of one or more elongate slots or voids extending longitudinally within the wall of the carrier apparatus spaced circumferentially about the bore of the apparatus to provide an unobstructed central flow path. The gauges are positioned or suspended within the slots. Thus, the gauges are located internally within the wall of the carrier apparatus such that they are completely housed within the apparatus. Typically, the bore of the carrier apparatus is centrally located such that a wall thickness between the bore of the apparatus and the outer circumference or perimeter of the apparatus is relatively uniform around the circumference. However, where necessary to accommodate the slots or voids within the wall thickness, the bore of the apparatus may be eccentrically located to provide a thicker wall portion and a thinner wall portion, wherein the slot or void is located within the thicker wall portion.

Examples of this form of carrier apparatus are provided by the Instream Gauge Carriers manufactured by Halliburton Energy Services, Inc., U.S. Pat. No. 4,711,123 issued Dec. 8, 1987 to Christensen, U.S. Pat. No. 3,225,830 issued Dec. 28, 1965 to Livingston, U.S. Pat. No. 5,320,169 issued Jun. 14, 1994 to Delatorre, PCT Publication No. WO87/02095 published Apr. 9, 1987 by Wierzba and U.S. Pat. No. 3,939,705 issued Feb. 24, 1976 to Glotin et. al.

As discussed above, a "full bore" string and an unobstructed flow path through the carrier apparatus are preferred in most operations to allow the running of various downhole tools and equipment into and out of the borehole, as well as permit the unobstructed flow of fluid therethrough. Thus, the minimum circumference of the bore of the carrier apparatus is dependent upon the need to accommodate the passage of such downhole tools and equipment therethrough and to provide a "full bore" pipe string. Further, to facilitate the transport of the carrier apparatus through the borehole, the outer diameter or circumference of the carrier apparatus will be limited by the size of the borehole. Accordingly, preferably, the outer circumference of the carrier apparatus does not exceed the outer diameter or circumference of the pipe string.

The difference between the outer circumference of the apparatus and the circumference of the bore of the apparatus provides a limited wall thickness of the carrier apparatus.

For some gauges or instruments, this limited wall thickness may be insufficient for forming the longitudinally extending slots or voids therein as discussed above, whether the bore is concentrically or eccentrically positioned, while still providing adequate structural strength to withstand the pressures and axial loads encountered in the downhole operations. Specifically, the carrier apparatus must have adequate mechanical strength to withstand the pressures, torque and stretch that can be exerted on the pipe string during normal drilling or production operations.

Thus, in a further form of carrier apparatus, the carrier apparatus is comprised of one or more slots extending longitudinally along the outside of the apparatus wall for receiving the gauges. The gauges or instruments are then secured within the slots. Thus, the gauges are secured externally to the wall of the carrier apparatus and are not completely housed within the apparatus. Rather, the gauges and the slots are accessible externally of the apparatus. Once again, in order to provide a necessary wall thickness to accommodate the formation of an external slot therein, the bore of the carrier apparatus may be either centrally or eccentrically located within the apparatus.

Examples of this form of carrier apparatus are provided by the BC-100 Memory Gauge Bundle Carrier manufactured by Micro-Smart Systems, Inc., the Gauge Carrier manufactured by The Expro Group, U.S. Pat. No. 4,747,304 issued May 31, 1988 to King, U.S. Pat. No. 4,593,771 issued Jun. 10, 1986 to Comeau, U.S. Pat. No. 4,628,995 issued Dec. 16, 1986 to Young et. al. and U.S. Pat. No. 4,570,481 issued Feb. 18, 1986 to McLaurin.

Referring to The Expro Group Carrier Gauge the pressure or temperature gauge is secured within an external slot in the carrier body by a gauge clamp. King provides a pivoting measuring instrument which is connected into an externally formed elongate slot by pivotal instrument support means. When pivoted into the slot, a locking mechanism, such as a locking ring, secures the measuring instrument therein. Similarly, McLaurin provides an elongate arcuate or semi-circular slot machined in the outer surface of the carrier body for receipt of a cylindrical instrument bundle therein. The instrument bundle is connected into the slot and retained in place by pressure port adapters, a jig and a retaining ring. Comeau mounts a gauge externally in a groove milled out of a gauge carrier. Straps or clamps are provided to secure the gauge in the groove.

Young et. al. provides one more pressure gauges mounted externally on a gauge carrier. Specifically, the body of the carrier is machined longitudinally to provide three flat surfaces arranged in a triangular configuration about the bore of the carrier body. A lengthwise extending semi-rectangular groove is formed in each of the three flat surfaces for receiving the outer cylindrically shaped housing of the pressure gauges. At various locations along the length of each pressure gauge housing, clamp members are provided to frictionally affix the gauge housing to the carrier body. The clamp members have interior curved surfaces to conform to the outer cylindrical surface of the gauge housing. The clamping members provide a frictional clamping force which permits the gauge housing to longitudinally shift therein.

However, again, the wall thickness may be insufficient for forming the longitudinally extending slots along the outside of the apparatus wall, while still providing adequate structural strength or integrity to the apparatus. Specifically, the wall thickness may be insufficient to effectively constrain the carrier apparatus from expanding radially under the influence of pressure from within the bore of the apparatus or forces tending to deform the carrier apparatus.

Thus, there remains a need for a gauge or measuring instrument carrier apparatus for connection with a pipe string such that the gauges may be transported through a borehole as part of the pipe string, where the pipe string, and thus the carrier apparatus, is relatively small in diameter or otherwise is relatively thin walled. Particularly, there is a need for a carrier apparatus having adequate structural strength or integrity where the carrier apparatus is relatively small in diameter or is relatively thin walled.

SUMMARY OF INVENTION

The present invention relates to a carrier apparatus for connection with a pipe string for use in transporting at least one gauge downhole through a borehole. The present invention is particularly suited for circumstances where the pipe string and the carrier apparatus are relatively small in diameter or the wall of the carrier apparatus is otherwise relatively thin. In a preferred embodiment, the apparatus has a nominal size of about 2⅜ inches and an outside diameter of about 3 inches.

Further, the present invention relates to a carrier apparatus having sufficient structural strength or integrity to effectively constrain or inhibit the carrier apparatus from expanding radially under the influence of pressure from within the bore of the apparatus or forces tending to deform the carrier apparatus.

The invention is comprised of a carrier apparatus including a body having an outer surface and a gauge insert for interlocking with the outer surface of the body. The gauge insert is provided for carrying the gauges and is mounted with the outer surface of the body of the carrier apparatus such that the insert interlocks with the body and thus, tends to increase the structural strength of the body and accordingly the structural integrity of the carrier apparatus. Specifically, the interlocking between the body and the insert preferably comprises an interlocking interface which is shaped or configured such that the insert inhibits or constrains the radial expansion of the body.

The synergistic relationship between the insert and the body provides a carrier apparatus which tends to have relatively high structural integrity and is particularly useful in circumstances where the wall of the carrier body is relatively thin. For instance, in order to maintain a full bore of the pipe string through the carrier apparatus, the carrier body may be relatively thinned wall where the diameter of the pipe string into which the carrier apparatus is connected is relatively small such that the preferable diameter of the carrier apparatus is also relatively small.

In one aspect of the invention, the invention is comprised of a carrier apparatus for connection with a pipe string for use in transporting at least one gauge downhole through a borehole, the apparatus comprising:

(a) a tubular body for connection with the pipe string having a bore for conducting a fluid therethrough and an outer surface, wherein the outer surface has at least one longitudinal recess formed therein, (b) at least one insert defining an internal chamber for receiving a gauge, wherein the insert is mounted with the body such that at least a portion of the insert is receivable within the recess for engagement therewith;

(c) an interlocking interface comprised of the engagement between the portion of the insert and the recess, wherein the interlocking interface is configured such that the insert inhibits radial expansion of the body adjacent the recess; and (d) at least one passage providing fluid communication between the gauge and one of the bore of the body and the borehole.

The interlocking interface between the insert and the recess may be comprised of any interconnecting or engaging surfaces capable of providing the desired interlocking or interconnection between the insert and the recess such that the insert inhibits, constrains or restricts the radial expansion of the body, particularly the portion of the body adjacent the recess. As discussed above, there is a tendency for radial expansion and deformation of the body when fluid passes under pressure through the pipe string and the bore of the tubular body of the carrier apparatus.

Further, the interlocking interface may have any configuration capable of providing or achieving the desired interlocking or interconnection as discussed. Preferably, the portion of the insert received within the recess is comprised of an insert interlocking surface, the recess is comprised of a recess interlocking surface compatible with the insert interlocking surface for engagement therewith and the interlocking interface is comprised of the engagement between the insert interlocking surface and the recess interlocking surface.

As indicated, the insert interlocking surface and the recess interlocking surface may have any compatible configurations permitting the interlocking of the surfaces in a manner to inhibit the radial expansion of the body. However, preferably, the recess interlocking surface is configured to define at least one interlocking shoulder and the insert interlocking surface is configured to define at least one compatible interlocking seat such that the interlocking shoulder engages the interlocking seat. In the preferred embodiment, the insert interlocking surface is configured to define two interlocking seats extending longitudinally along opposed sides of the insert and the recess interlocking surface is configured to define two interlocking shoulders for receipt in the interlocking seats. Thus, radial expansion of the body adjacent the recess will be inhibited by the engagement of the interlocking shoulders of the recess interlocking surface in the compatible seats of the insert interlocking surface.

The interlocking shoulder and the compatible interlocking seat may be provided by any configuration of the interlocking surfaces. However, in the preferred embodiment, the interlocking shoulder and compatible seat are provided by a flange and groove configuration of the interlocking surfaces.

Preferably, the insert interlocking surface is comprised of at least one longitudinally extending flange defining the interlocking seat and the recess interlocking surface is comprised of at least one groove therein defining the interlocking shoulder, wherein the groove is compatible with the flange for engagingly receiving the flange therein. In the preferred embodiment, the insert interlocking surface is comprised of two flanges extending longitudinally along opposed sides of the insert defining the interlocking seats and the recess interlocking surface defines two grooves therein defining the interlocking shoulders, wherein the grooves are compatible with the flanges for engagingly receiving the flanges therein.

The outer surface of the body of the carrier apparatus defines a circumferential perimeter of the carrier apparatus. In order to facilitate the transport of the carrier apparatus through the borehole, the carrier apparatus and particularly the outer circumferential perimeter is sized to fit within the borehole. Thus, typically, the outer circumferential perimeter is also sized such that the outer circumferential perimeter of the carrier apparatus will not exceed the outer diameter or circumference of the pipe string.

As a result, in the preferred embodiment, the insert has an outer surface and the outer surface of the insert is configured such that the outer surface if the insert is substantially contained within the circumferential perimeter of the apparatus when the insert is received within the recess. Further, the outer surface of the insert is preferably configured such that the outer surface of the body and the outer surface of the insert together provide a substantially cylindrical circumferential perimeter of the carrier apparatus for passage through the borehole.

The tubular body may be comprised of a single integral tubular member or it may be comprised of two or more tubular members permanently or detachably connected, fastened or affixed together to provide the tubular body. Further, the tubular body is connectable with the pipe string in any manner permitting the transportation of the carrier apparatus through the borehole as part of the pipe string and permitting the relatively unobstructed flow of fluids through the bore of the body from the pipe string. In the preferred embodiment, the tubular body has opposed threaded ends for threaded connection with compatible ends of the adjacent pipe string.

The pipe string may be comprised of any downhole pipe or tubing used for production or drilling operations. Preferably, the pipe string is comprised of a tubing string and the body is adapted for connection with the tubing string to provide continuous fluid communication with the tubing string through the bore of the body.

As stated, at least one insert is mounted with the body in at least one recess formed in the body. However, where desired or required, the outer surface of the body may have greater than one longitudinal recess formed therein for receiving the insert such that greater than one gauge may be transported by the apparatus, wherein the recesses are preferably longitudinally spaced along a length of the body. Alternately, the recesses may be spaced circumferentially about the bore of the body.

The insert may also be comprised of a single integral member or it may be comprised of two or more members permanently or detachably connected, fastened or affixed together to provide the insert. Preferably, the insert is comprised of at least two insert members interconnected to form the insert defining the internal chamber therein. Further, the insert is preferably comprised of a sealing assembly associated with at least one of the insert members such that the insert members are sealingly interconnected to form the insert.

In the preferred embodiment, the insert is comprised of three insert members. In particular, the insert is preferably comprised of a gauge insert member defining a gauge portion of the internal chamber for receiving the gauge therein. Further, the insert is preferably comprised of a power source insert member defining a power source portion of the internal chamber for receiving a power source for the gauge therein, wherein the gauge insert member and the power source insert member are connected to permit communication between the gauge portion and the power source portion of the internal chamber. Finally, the insert is preferably comprised of a fluid port insert member, wherein the passage is defined by the fluid port insert member and wherein the gauge insert member and the fluid port insert member are connected to permit fluid communication with the gauge through the passage.

In the preferred embodiment, the insert members may be connected, fastened or affixed together, either permanently or detachably, using any interconnecting structure or mechanism. However, preferably, the insert members are detachably interconnected to permit access to each of the insert members, including the gauge and the power source received therein for maintenance, repair or replacement. Further, one or more of the insert members, and preferably each of the insert members, are preferably sealingly interconnected. Thus, in the preferred embodiment, the insert is further comprised of a sealing assembly associated with the insert members such that the insert members are sealingly interconnected. Any type or configuration of sealing assembly may be used such as one or more seals or O-rings located or positioned between the insert members.

As indicated, the gauge insert member defines a gauge portion of the internal chamber for receiving a gauge therein. The gauge is comprised of at least one sensor or measuring instrument for sensing or measuring at least one downhole parameter or condition such as pressure, temperature or fluid flow. The gauge may communicate to the information or data to the surface by a wireline or other method of communication, however, preferably, the gauge further includes a recorder or memory device for storing the data or information for later retrieval to the surface.

The carrier apparatus is comprised of at least one passage providing fluid communication between the gauge and one of the bore of the body and the borehole. Where the apparatus is comprised of greater than one insert, wherein each insert receives a gauge, the apparatus provides a passage for fluid communication between each gauge and one of the bore of the body and the borehole. Thus, one gauge may be in fluid communication with the bore of the body, while another gauge may be in fluid communication with the borehole.

Where information or data concerning the parameters or conditions of the bore of the body is desired or required, the passage may extend through any portion of the body and the insert permitting the fluid to communicate between the bore of the body and the gauge. Preferably, as indicated, the passage extends through the fluid port insert member of the insert. In the preferred embodiment, the body defines a fluid port extending between the bore of the body and the recess interlocking surface. Further, the passage defined by the fluid port insert member extends between the gauge portion of the internal chamber and the fluid port to provide fluid communication between the bore of the body and the gauge. In this instance, the gauge preferably measures at least one of the pressure, temperature and flow of the fluid conducted through the bore of the body.

Where information or data concerning the parameters or conditions of the borehole is desired or required, the passage may extend from the outer surface of the insert through any portion of the insert. Preferably, as indicated, the passage extends through the fluid port insert member of the insert. In the preferred embodiment, the passage defined by the fluid port insert member extends between the gauge portion of the internal chamber and the outer surface of the insert to provide fluid communication between the borehole and the gauge. In this instance, the gauge preferably measures at least one of the pressure, temperature and flow of a fluid contained within the borehole.

The insert may be permanently mounted, attached, affixed or otherwise fastened with the body in any manner and by any mechanism capable of maintaining the engagement between the portion of the insert receivable within the recess and the recess to provide the interlocking interface. However, for ease of maintenance, repair and replacement, the insert is preferably releasably mounted, attached, affixed or otherwise fastened with the body. Again, the insert may be releasably mounted, attached, affixed or otherwise fastened with the body in any manner and by any mechanism capable of releasably maintaining the engagement between the portion of the insert receivable within the recess and the recess to provide the interlocking interface.

Preferably, the insert is mounted with the body by at least one fastener. One or more of any type or combination of types of fastener may be used, such as screws or bolts. Further, each fastener may pass or extend through any portion of the insert and the body.

Preferably, the carrier apparatus is comprised of at least one fastener for releasably mounting the insert with the body to maintain the engagement between the insert interlocking surface and the recess interlocking surface, wherein the fastener extends between the insert interlocking surface and the recess interlocking surface. In the preferred embodiment, the carrier apparatus is comprised of at least one pair of fasteners for releasably mounting the insert with the body to maintain the engagement between the insert interlocking surface and the recess interlocking surface, wherein the pair of fasteners extends between the insert interlocking surface and the recess interlocking surface. In this instance, each fastener of the pair of fasteners is preferably positioned along opposed sides of the insert.

As a result of the potential deformation of the carrier apparatus during use, the carrier apparatus is preferably further comprised of a mechanism for releasing or facilitating the release of the engagement between the insert interlocking surface and the recess interlocking surface in order to be able to remove the insert from the recess. Although any release mechanism or structure may be used, the carrier apparatus is preferably further comprised of at least one jackscrew extending between the insert interlocking surface and the recess interlocking surface for releasing the engagement between the insert interlocking surface and the recess interlocking surface in order to remove the insert from the recess.

SUMMARY OF DRAWINGS

Embodiments of the invention will now be described with reference to the accompanying drawings, in which.

DETAILED DESCRIPTION

Figure 1:
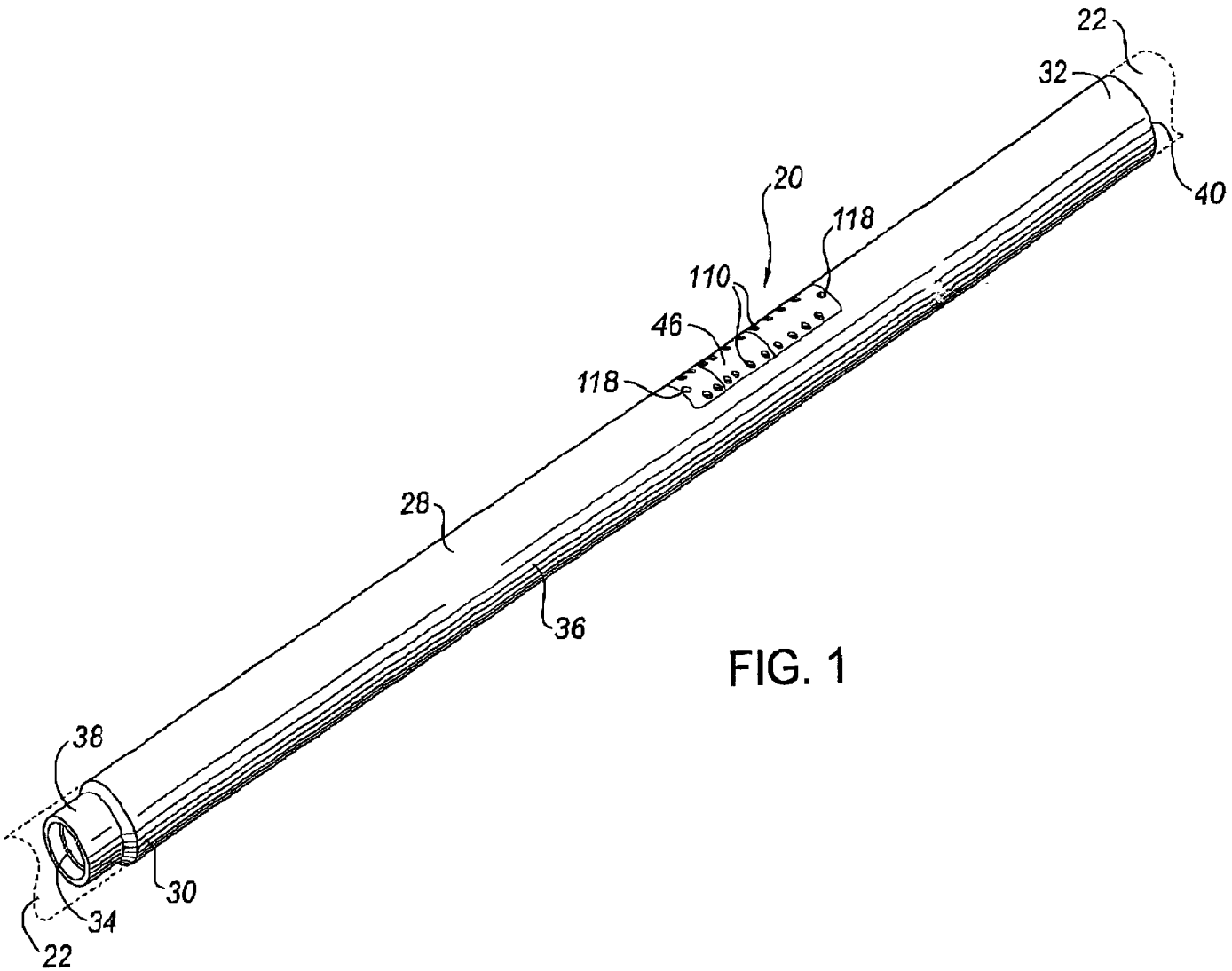
FIG. 1 is a pictorial view of a preferred embodiment of a carrier apparatus including a body and an insert.
Figure 2:
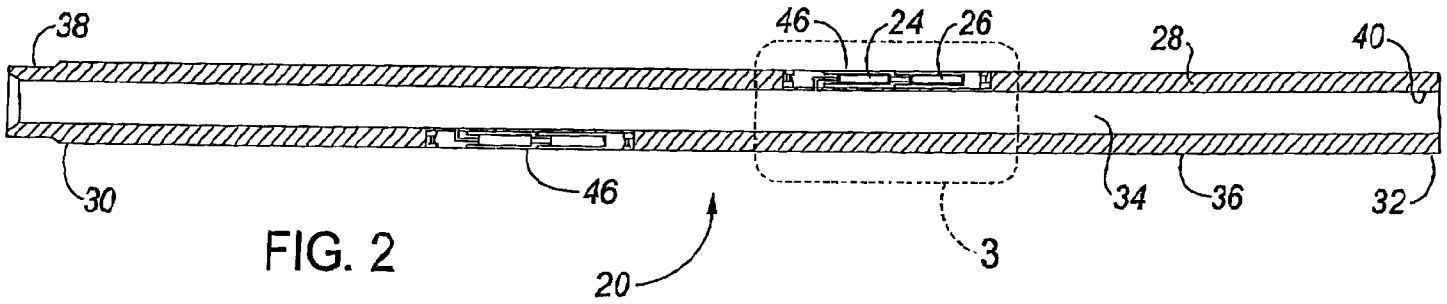
FIG. 2 is a longitudinal sectional view of the carrier apparatus shown in FIG. 1 having a gauge and a power source contained within the insert.

Referring to FIGS. 1–2, the invention is comprised of a carrier apparatus (20) which is adapted for connection with a pipe string (22) such that the carrier apparatus (20) forms a part of the pipe string (22). The carrier apparatus (20) is for use in transporting, carrying or conveying at least one gauge (24) downhole through a borehole so that the gauge (24) is positioned within the borehole for sensing or measuring one or more downhole parameters or conditions.

The apparatus (20) may be connected with any type or manner of pipe string (22) which is typically comprised of one or more tubular members or elements connected or fastened together to provide the pipe string (22) which extends from the surface to a desired location or position downhole. The pipe string (22) may be of the type typically used for any downhole operation such as drilling, production or maintenance of the borehole. The borehole may be for the production of any downhole fluids including oil, water, gas or a combination thereof. Preferably, the pipe string (22) is comprised of a tubing string. Further, preferably, the apparatus (20) is connected with the tubing string (22) for use while drilling or maintaining the borehole.

The carrier apparatus (20) may be adapted for connection with or into the pipe string (22) in any manner and by any mechanism or structure for permanently or detachably making such a connection between the apparatus (20) and the pipe string (22). For instance, the apparatus (20) may be permanently connected with the pipe string (22) by welding portions of the pipe string (22) to the apparatus (20) at opposed ends thereof such that the apparatus (20) is integrally formed or connected therewith. However, preferably, the apparatus (20) is detachably or removably connected with or into the pipe string (22) such that the apparatus (20), along with the gauge or gauges (24) may be positioned in the pipe string (22) and removed as desired or required for any particular downhole operation, such as production, drilling or maintenance of the borehole. In this case, as described further below, the apparatus (20) is removably connected with the pipe string (22) by any detachable mechanism for connecting, fastening, affixing or otherwise attaching the opposed ends of the carrier apparatus (20) with the adjacent portions of the pipe string (22).

Further, the carrier apparatus (20) is adapted for connection with the pipe string (22) such that fluid may be communicated continuously through the pipe string (22) and the apparatus (20) in a relatively unobstructed manner. Specifically, as described further below, the carrier apparatus (20) provides a fall through bore to permit the passage of fluid, instruments and any necessary downhole equipment through the bore of the apparatus (20) to and from the pipe string (22) in a relatively unimpeded or unobstructed manner such that the carrier apparatus (22) does not significantly or substantially interfere with or obstruct such passage.

As indicated, the apparatus (20) is for use in transporting at least one gauge (24) within the borehole. Each gauge (24) is comprised of at least one sensor or measuring instrument (not shown) for sensing or measuring at least one downhole parameter or condition desired to be monitored or measured, such as pressure, temperature or fluid flow. Thus, each gauge (24) may sense or measure one or more parameters or conditions concurrently. The gauge (24) may be comprised of one or a combination of any suitable sensors or measuring instruments compatible for use downhole. The gauge (24) must further be sized and configured such that the gauge (24) is suitable or compatible for use within the apparatus (20) as described further below.

The gauge (24) may be used, as described further below, for measuring either the parameters or conditions of the fluids within the borehole external to the apparatus (20) or the parameters or conditions of the fluids conducted internally through the apparatus (20). For instance, the gauge (24) may measure at least one of the pressure, temperature and flow of the fluid or fluids contained within the borehole. Alternately, the gauge (24) may measure at least one of the pressure, temperature and flow of the fluid or fluids being conducted through the bore of the apparatus (20). In the preferred embodiment, at least one gauge (24) is comprised of a pressure gauge for measuring the pressure either externally or internally of the apparatus (20).

The data or information sensed or measured by the gauge (24) may be communicated to the surface in any manner such as by a wireline or electronic cable. However, preferably, the gauge (24) records and stores the data or information for later retrieval to the surface. Accordingly, the gauge (24) is preferably further comprised of a recorder or memory device (not shown) for recording and storing the data or information downhole. The recorder or memory may be comprised of one or a combination of any suitable recorders or memory devices compatible for use downhole. The recorder or memory device must further be sized and configured such that it is suitable or compatible for use within the apparatus (20). In the preferred embodiment, at least one gauge (24) is comprised of a memory pressure gauge.

Further, a source or supply of power must be provided to the gauge (24) including the sensors or measuring instruments as well as the recorder or memory device. The power may be supplied from the surface in any manner such as by a wireline or cable. However, preferably, the apparatus (20) is comprised of a power source (26) contained or positioned within the apparatus (20) as described further below. Any power source, such as a battery, may be used which is suitable for providing the necessary power supply to the gauge (24) for a desired or required period of time prior to retrieval of the apparatus (20) to the surface and which is compatible for use downhole. The power source (26) must further be sized and configured such that it is suitable or compatible for use within the apparatus (20) as described further below.

Preferably, the apparatus (20) is comprised of a tubular body (28) for connection with the pipe string (22). The tubular body (28) has a first end (30), an opposed second end (32) and a bore (34) extending therebetween for conducting a fluid therethrough. Further, the tubular body (28) has an outer surface (36) which defines a circumferential perimeter of the carrier apparatus (20).

The tubular body (28) may be comprised of two or more tubular members or elements permanently or detachably connected, fastened or affixed together to provide the tubular body (28). However, preferably, the body (28) is comprised of a single integral tubular member or element, such as a length of pipe or tubing.

As stated, the carrier apparatus (20) is adapted for connection with the pipe string (22). In the preferred embodiment, the first and second ends (30, 32) of the tubular body (28) are connected into the pipe string (22) such that the body (28) forms a part of the pipe string (22). The first and second ends (30, 32) may be connected, fastened, affixed or otherwise attached, either permanently or detachably, with the adjacent portions of the pipe string (22) in any manner and by any mechanism for such connection, fastening, affixation or attachment. In the preferred embodiment, the first and second ends (30, 32) are removably connected with the pipe string (22) by threaded connections at each of the first and second ends (30, 32). Preferably, the first end (30) is comprised of a threaded outer surface (38) providing or forming a threaded pin connector for connection with a compatible portion of the pipe string (22). Further, the second end (32) is preferably comprised of a threaded inner surface (40) providing or forming a threaded box connector for connection with a compatible portion of the pipe string. Thus, when threadably connected therewith, the body (28) of the carrier apparatus (20) forms a part of the pipe string (22).

Further, the body (28) of the carrier (20) is adapted for connection with the pipe string (22) in a manner to provide continuous fluid communication with the pipe string (22) through the bore (34) of the body (28). The bore (34) is preferably sized and configured such that the bore (34) of the body (28) is substantially similar to the bore of the pipe string in order to permit the passage of fluid and downhole instruments through the pipe string (22) including the carrier apparatus (20). In other words, the bore (34) of the body (28) preferably provides a full through bore with the pipe string (22).

As well, in order to permit the passage or conveyance of the apparatus (20) downhole with the pipe string (22), the outer surface (36) of the body (28) is sized and configured such that the circumferential perimeter of the apparatus (20) is compatible for passage through the borehole. Preferably, the outer circumferential perimeter of the apparatus (20) is substantially similar to the circumference or perimetrical dimension of the pipe string (22).

The outer surface (36) of the tubular body (28) has at least one recess (42) formed therein. Preferably, each recess (42) is elongate and extends longitudinally substantially parallel with the bore (28). Each recess (42) is adapted for receiving a gauge (24) therein as described in detail below. Thus, where the apparatus (20) preferably includes greater than one gauge (24), the outer surface (36) has greater than one longitudinally extending recess (42) formed therein. In this case, the recesses (42) may be spaced along and about the outer surface (36) in any pattern or configuration compatible with the placement of the gauges (24) in the apparatus (20).

For instance, the recesses (42) may be positioned longitudinally at the same location along the length of the body (28), while being spaced circumferentially or perimetrically about the bore (34) of the body (28). However, preferably, the recesses (42) are longitudinally spaced along the length of the body (28) between the first and second ends (30, 32). Further, in this preferred embodiment, although the recesses (42) may be circumferentially positioned in the same location relative to the bore (28), the recesses (42) are preferably spaced circumferentially about the bore (34) as shown in FIG. 2.

Each recess (42) may be formed in the outer surface (36) of the body (28) in any manner and by any suitable process or mechanism. For instance, the recess (42) may be molded or cast into the body (28) in the desired configuration. However, preferably, the recess (42) is milled or machined into the outer surface (36) to the desired configuration. In the preferred embodiment, the recess (42) is comprised of a recess interlocking surface (44).

Figure 3:
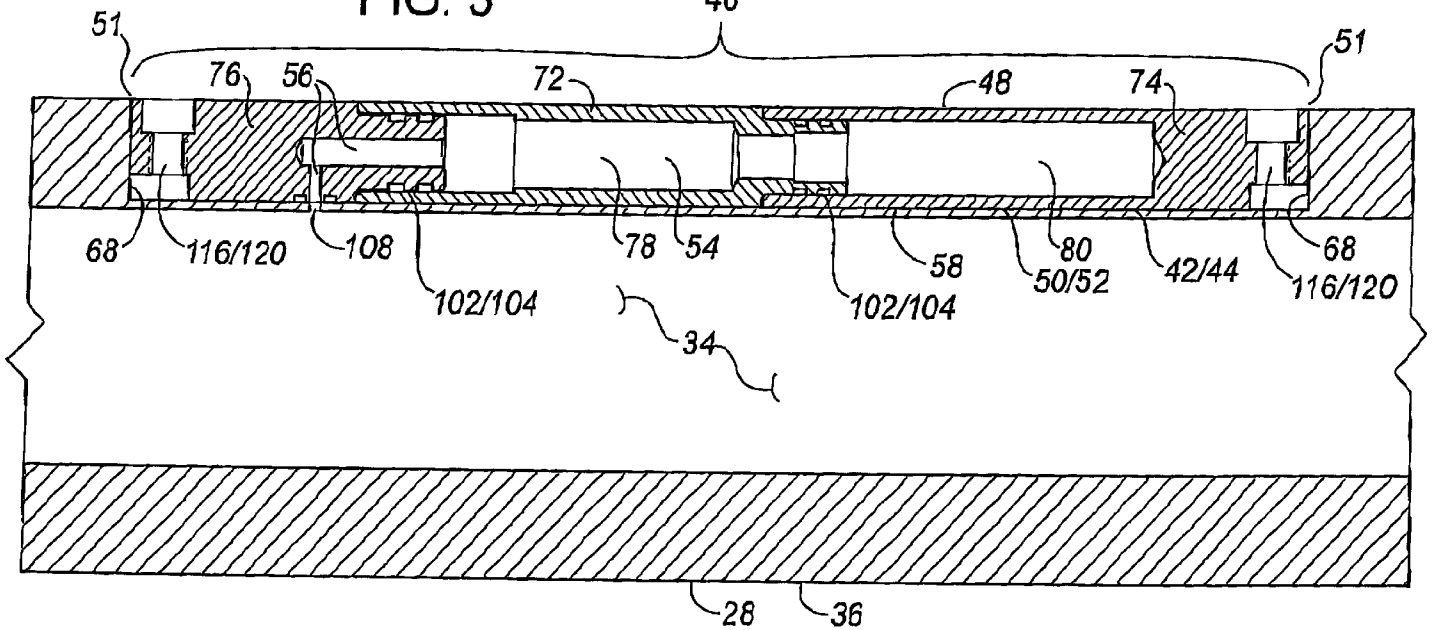
FIG. 3 is a detailed longitudinal section view of a portion of the carrier apparatus as outlined in FIG. 2, wherein the gauge and the power source have been removed therefrom.
Figure 4:
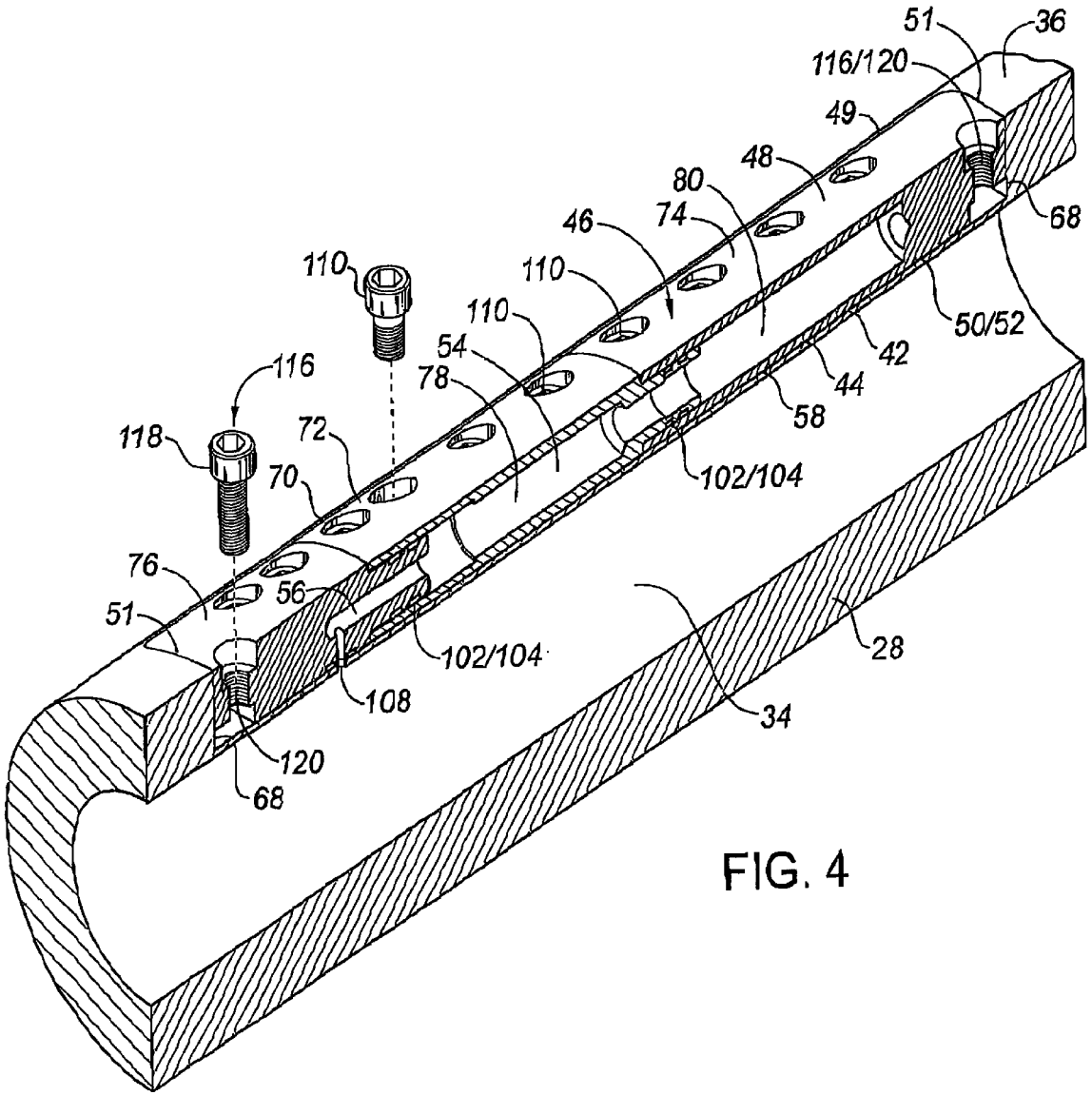
FIG. 4 is a further detailed pictorial view of the longitudinal section of the carrier apparatus shown in FIG. 3.
Figure 5:
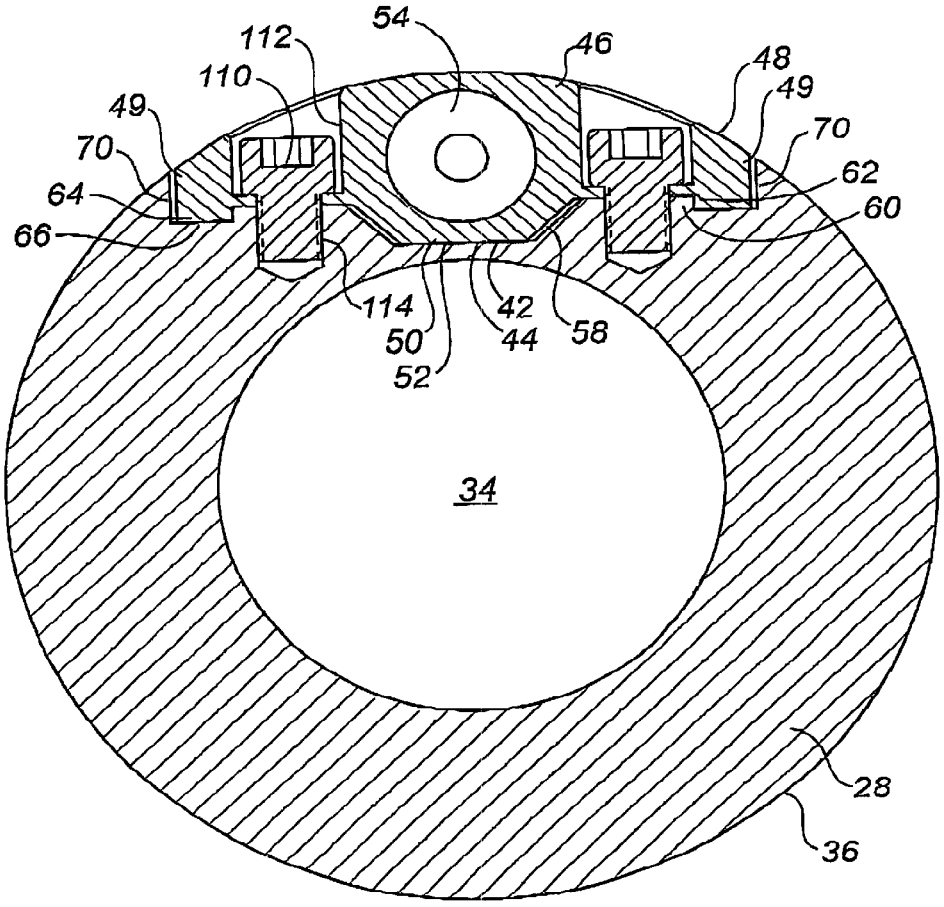
FIG. 5 is a cross-sectional view of the insert and the body of the carrier apparatus shown in FIG. 3.
Figure 6:
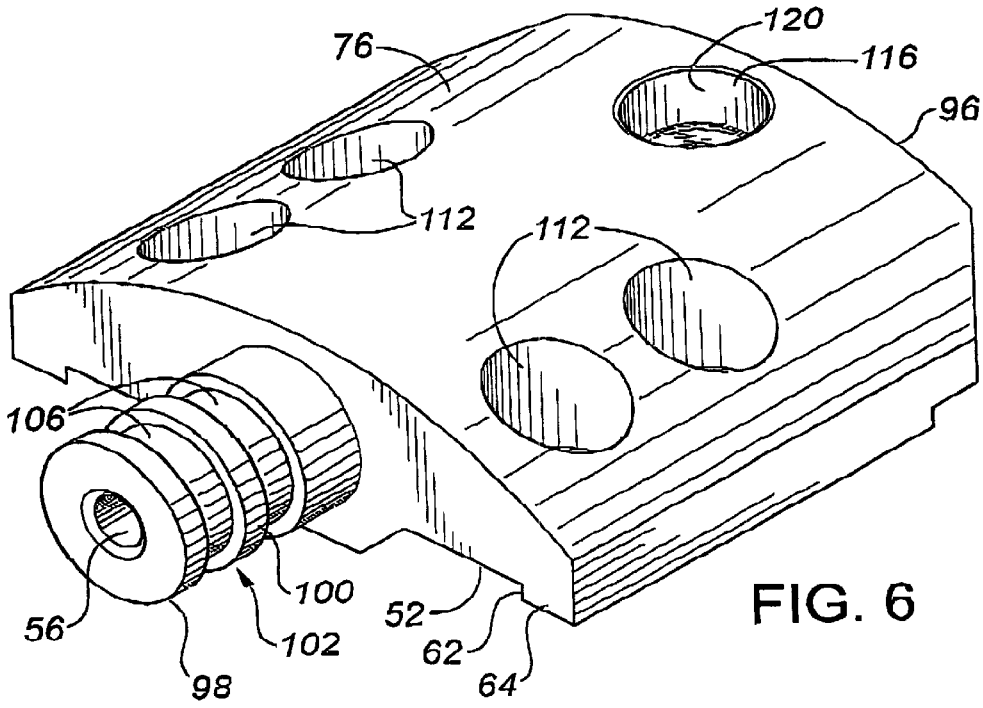
FIG. 6 is a pictorial view of a fluid port insert member comprising the insert of the carrier apparatus shown in FIG. 1.
Figure 7:
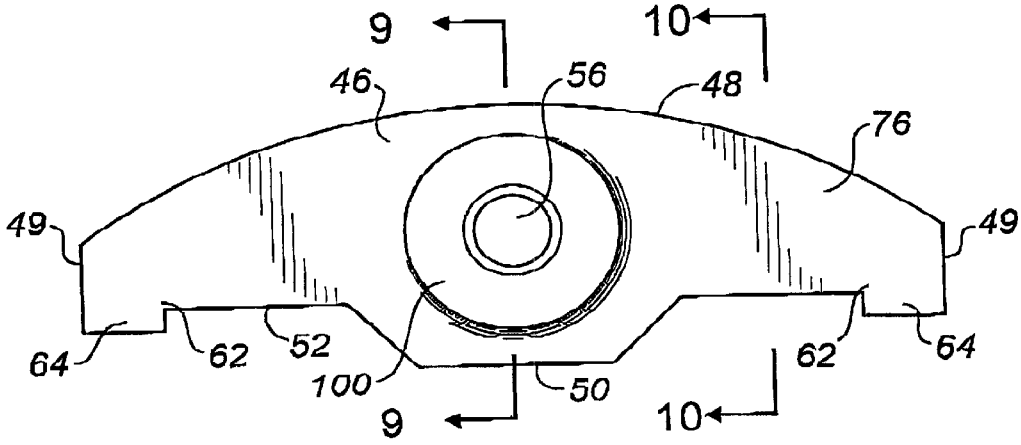
FIG. 7 is a proximal end view of the fluid port insert member shown in FIG. 6.
Figure 8:
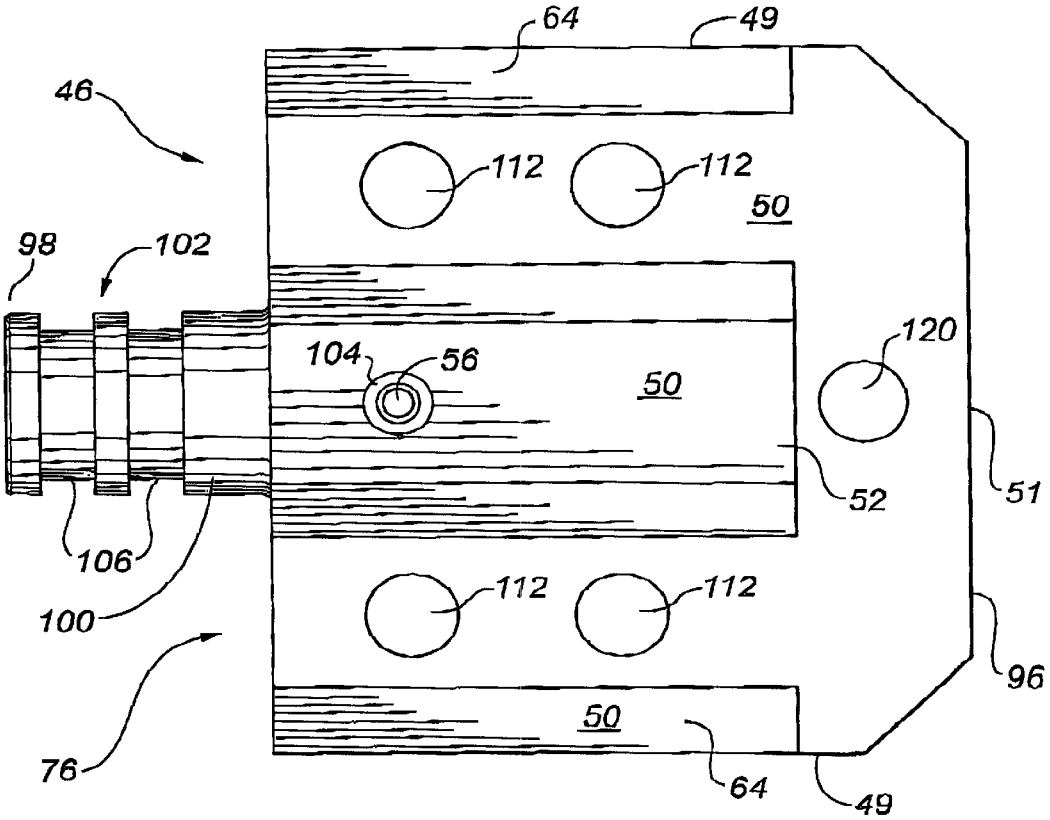
FIG. 8 is a bottom view of the fluid port insert member shown in FIG. 6.

Referring to FIGS. 3–5, the carrier apparatus (20) is further comprised of at least one insert (46) which is mounted with the body (28). Preferably, the insert (46) is elongate and adapted for mounting with the body (28) such that at least a portion of the insert (46) is received within the recess (42) for engagement therewith. The insert (46) has an outer surface (48), an inner surface (50), opposed sides (49) and opposed ends (51). The inner surface (50) preferably defines the portion of the insert (46) received within the recess (42). In the preferred embodiment, the inner surface (50) is comprised of an insert interlocking surface (52).

The outer surface (48) of the insert (46) may have any configuration compatible with its passage through the borehole. Thus, depending upon the size of the borehole, the outer surface (48) of the insert (46) may extend from or beyond the circumferential perimeter of the apparatus (20) defined by the outer surface (36) of the body (28). However, preferably, the outer surface (48) of the insert (46) is configured such that the outer surface (48) is substantially contained within the circumferential perimeter of the apparatus (20) when the insert (46) is received within the recess (42). In the preferred embodiment, the outer surface (48) of the insert (46) is substantially flush with the circumferential perimeter as shown in FIGS. 4 and 5 such that the apparatus (20) is substantially circular on cross-section. Although the outer surface (48) may be positioned significantly within the circumferential perimeter, this is not typically preferred primarily for aesthetic reasons.

The outer surface (48) may be sized and configured prior to mounting the insert (46) within the recess (42). However, preferably, the insert (46) is first mounted within the recess (42). The outer surface (48) of the insert (46) is then machined to provide a curvature matching the curvature of the outer surface (36) of the body (28).

Further, the insert (46) defines an internal chamber (54) for receiving and protecting the gauge (24) therein. In the preferred embodiment, the internal chamber (54) also receives and protects the power source (26) therein. The internal chamber (54) is sized and configured to be compatible with the gauge (24) and the power source (26) to be received therein.

In order to permit communication of either the internal or the external fluid with the gauge (24), the apparatus (20) is further comprised of at least one passage (56) providing fluid communication between the gauge (24) and one of the bore (34) of the body (28) and the borehole. Thus, in the preferred embodiment, the passage (56) extends between one of the bore (34) of the body (28) and the borehole and the internal chamber (54) of the insert (46) adjacent the gauge (24) such that the fluid may communicate therewith.

In addition, the carrier apparatus (20) is comprised of an interlocking interface (58) between the insert (46) and the recess (42) which is shaped or configured such that the insert (46) inhibits or constrains the radial expansion of the body (28), particularly adjacent the recess (42). The interlocking interface (58) enhances the structural strength and integrity of the carrier apparatus (20) particularly where the apparatus (20) includes areas of reduced thickness of the body (28) such as between the bore (34) of the body (28) and the recess interlocking surface (44). The thickness of the body (28) will typically be reduced upon increasing the size of the bore (34) of the body (28), decreasing the circumferential perimeter of the apparatus (20), increasing the depth of the recess (42) formed in the body (28) or a combination thereof.

The interlocking interface (58) between the insert (46) and the recess (42) may be comprised of any interconnecting or engaging surfaces capable of providing the desired interlocking or structural interconnection between the insert (46) and the recess (42) such that the insert (46) inhibits, constrains or restricts the radial expansion of the body (28), particularly the portion of the body (28) adjacent the recess (42). As a result, radial expansion and deformation of the body (28) when fluid passes under pressure through the pipe string (22) and the bore (34) of the tubular body (28) of the carrier apparatus (20) tends to be reduced.

Preferably, the interlocking interface (58) is comprised of the engagement between the portion of the insert (46) received within the recess (42) and the recess (42). In the preferred embodiment, the recess interlocking surface (44) is compatible with the insert interlocking surface (52) for engagement therewith. Thus, the interlocking interface (58) is comprised of the engagement between the insert interlocking surface (52) and the recess interlocking surface (44).

The insert interlocking surface (52) and the recess interlocking surface (44) may have any compatible configurations permitting or providing for the interlocking or structural interconnection of the engaged surfaces (52, 44) to inhibit the radial expansion of the body (28).

However, referring to FIGS. 4 and 5, the interlocking interface (58) is preferably comprised of an interlocking shoulder (60) provided between the insert interlocking surface (52) and the recess interlocking surface (44). More particularly, the surfaces (52, 44) are configured to define and provide the interlocking shoulder (60) which is receivable within a compatible interlocking seat (62). Preferably, the recess interlocking surface (44) is configured to defines at least one, and preferably two, radially extending and outwardly facing interlocking shoulders (60) which are receivable within one, and preferably two, compatible interlocking seats (62). The insert interlocking surface (52) is configured to define the interlocking seats (62). Accordingly, expansion of the body (28) causes the interlocking shoulders (60) to be more firmly or closely engaged with the interlocking seats (62). The interlocking shoulder and seat (60, 62) may have any shape compatible with the close engagement of the shoulder (60) within the seat (62). However, preferably, each of the interlocking shoulder and seat (60, 62) defines or provides about a 90 degree angle.

The interlocking shoulders (60) and the compatible interlocking seats (62) may be provided by any configuration of the interlocking surfaces (44, 52). However, in the preferred embodiment, the interlocking shoulders and seats (60, 62) are comprised of or provided by a flange and groove configuration of the interlocking surfaces (44, 52).

Preferably, the insert interlocking surface (52) of the elongate insert (46) is comprised of at least one longitudinally extending flange (64). More particularly, the flange (64) extends longitudinally for a portion of the length of the insert (46) between the opposed ends (51) of the insert (46). Preferably, the flange (64) extends longitudinally for substantially the entire length of the insert (46) between the opposed ends (51) of the insert (46). The formation or provision of the flange (64) in the insert interlocking surface (52) provides the interlocking seat (62).

In the preferred embodiment, the insert interlocking surface (52) is comprised of two longitudinally extending flanges (64). Specifically, each flange (64) extends longitudinally for a portion of the length of the insert (46) between the opposed ends (51) of the insert (46). Preferably, each flange (64) extends longitudinally for substantially the entire length of the insert (46) between the opposed ends (51) of the insert (46). Further, although each flange (64) may be located at any position between the opposed sides (49) of the insert (46), one flange (64) preferably extends along or extends adjacent to each of the opposed sides (49). The formation or provision of the opposed flanges (64) in the insert interlocking surface (52) provides the two interlocking seats (62) in the preferred embodiment.

Each flange (64) is comprised of a ridge, rim or projection extending from the inner surface (50) of the insert (46) and may have any shape or configuration compatible with and suitable for interlocking with the recess interlocking surface (44).

Preferably, the recess interlocking surface (44) of the elongate recess (42) is comprised of at least one longitudinally extending groove (66) compatible with the flange (64) for engagingly receiving the flange (64) such that the flange (64) interlocks with the groove (66). More particularly, the groove (66) extends longitudinally for a portion of the length of the recess (42) between opposed ends (68) of the recess (42). Preferably, the groove (66) extends longitudinally for substantially the entire length of the recess (42) between the opposed ends (68) of the recess (42). The formation or provision of the groove (66) in the recess interlocking surface (44) provides the interlocking shoulder (60).

In the preferred embodiment, the recess interlocking surface (44) is comprised of two longitudinally extending grooves (66) compatible with the flanges (64) for engagingly receiving the flanges (64) such that the flanges (64) interlock with the grooves (66). Specifically, each groove (66) extends longitudinally for a portion of the length of the recess (42) between the opposed ends (68) of the recess (42). Preferably, each groove (66) extends longitudinally for substantially the entire length of the recess (42) between the opposed ends (68) of the recess (42). Further, although each groove (66) may be located at any position between opposed sides (70) of the recess (42), one groove (66) preferably extends along or extends adjacent to each of the opposed sides (70) for receipt of the flanges (64) extending along the opposed sides (49) of the insert (46). The formation or provision of the opposed grooves (66) in the recess interlocking surface (44) provides the two interlocking shoulders (60) in the preferred embodiment.

Each groove (66) is comprised of slot, channel or indentation extending within the recess interlocking surface (44) and may have any shape or configuration compatible with and suitable for interlocking with the flanges (64) of the insert interlocking surface (52).

The insert (46) may be comprised of a single integral member or element. However, preferably, the insert (46) is comprised of two or more members or elements permanently or detachably interconnected, fastened or affixed together to form the insert (46) defining the internal chamber (54) therein. In the preferred embodiment, the insert (46) is comprised of three insert members interconnected together. In particular, the insert (46) is comprised of a gauge insert member (72), a power source insert member (74) and a fluid port insert member (76). These three insert members (72, 74, 76) are arranged and connected end to end. Although the insert members may be interconnected in any order, the gauge insert member (72) is preferably connected between the power source insert member (74) and the fluid port insert member (76). In addition, the insert (46) may be mounted within the recess (42) such that either the power source insert member (74) or the fluid port insert member (76) is located most distally in the apparatus (20). However, in the preferred embodiment, the most distal or downhole member is the fluid port insert member (76), while the most proximal or uphole member is the power source insert member (74).

The gauge insert member (72) defines a gauge portion (78) of the internal chamber (54) which is sized and configured for receiving the gauge (24) therein. The power source insert member (74) defines a power source portion (80) of the internal chamber (54) which is sized and configured for receiving the power source (26) for the gauge (24) therein. The fluid port insert member (76) defines the passage (56) providing fluid communication with the gauge (24).

As described further below, the gauge insert member (72) and the power source insert member (74) are adapted to be connected in a manner permitting communication between the gauge portion (78) and the power source portion (80) of the internal chamber (54) such that the power source (26) is connectable with the gauge (24). The gauge insert member (72) and the fluid port insert member (76) are adapted to be connected in a manner permitting fluid communication with the gauge (24) through the passage (56) defined by the fluid port insert member (76).

The gauge insert member (72), the power source insert member (74) and the fluid port insert member (76) may be connected, fastened or affixed together, either permanently or detachably, using any interconnecting structure or mechanism. However, preferably, the gauge insert member (72), the power source insert member (74) and the fluid port insert member (76) are detachably interconnected to permit access to each of the insert members (72, 74, 76), including the gauge (24) and the power source (26) received therein for maintenance, repair or replacement. In the preferred embodiment, compatible male and female connectors between adjacent ends or edges of the gauge insert member (72), the power source insert member (74) and the fluid port insert member (76) provide the connection and communication therebetween.

Specifically, referring to FIGS. 11–14, in the preferred embodiment, the gauge insert member (72) has a distal end (82) and a proximal end (84) wherein the gauge portion (78) of the internal chamber (54) extends therebetween. The distal end (82) is preferably comprised of a female connector (86) for receipt of a compatible male connector of the adjacent fluid port insert member (76) therein. The proximal end (84) is preferably comprised of a male connector (88) for insertion within a compatible female connector of the adjacent power source insert member (74).

Referring to FIGS. 15–18, in the preferred embodiment, the power source insert member (74) has a distal end (90) and a proximal end (92) wherein the power source portion (80) of the internal chamber (54) extends from the distal end (90) within the power source insert member (74). The distal end (90) is preferably comprised of a female connector (94) for receipt of the compatible male connector (88) of the adjacent gauge insert member (72) therein.

Referring to FIGS. 6–10, in the preferred embodiment, the fluid port insert member (76) has a distal end (96) and a proximal end (98) wherein the passage (56) extends from the proximal end (98) within the fluid port insert member (76) as described further below. The proximal end (98) is preferably comprised of a male connector (100) for insertion within the compatible female connector (86) of the adjacent gauge insert member (72).

Preferably, one or more of the insert members (72, 74, 76), and preferably all of the insert members (72, 74, 76), are sealingly interconnected. Thus, the insert (46) is preferably further comprised of a sealing assembly (102) associated with at least one of the insert members (72, 74, 76), and preferably each of the insert members (72, 74, 76) such that the insert members (72, 74, 76) are sealingly interconnected. Any type or configuration of sealing assembly (102) may be used such as one or more sealing devices, seals or O-rings located or positioned between the insert members (72, 74, 76).

In the preferred embodiment, referring to FIGS. 3 and 4, the sealing assembly (102) is comprised of one or more O-rings (104) or other seals or sealing devices located or positioned between the female connector (94) at the distal end (90) of the power source insert member (74) and the adjacent male connector (88) at the proximal end (84) of the gauge insert member (72). Further, in the preferred embodiment, the sealing assembly (102) is comprised of one or more O-rings (104) or other seals or sealing devices located or positioned between the female connector (86) at the distal end (82) of the gauge insert member (72) and the adjacent male connector (100) at the proximal end (98) of the fluid port insert member (76). In the preferred embodiment, each of the O-rings (104) further includes one or more back-up rings such that a bi-directional seal may be provided.

Although each of the O-rings (104) may be maintained in position between the adjacent surfaces of the various male and female connectors in any manner and by any mechanism, preferably each of the male connectors (88, 100) defines one or more grooves (106) or indentations therein for receipt of the O-rings (104).

Where information or data concerning the parameters or conditions of the bore (34) of the body (28) is desired or required, the passage (56) may extend through any portion of the body (28) and the insert (46) permitting the fluid to communicate between the bore (34) of the body (28) and the gauge (24). Preferably, the passage (56) extends through the fluid port insert member (76) of the insert (46).

Figure 9A:
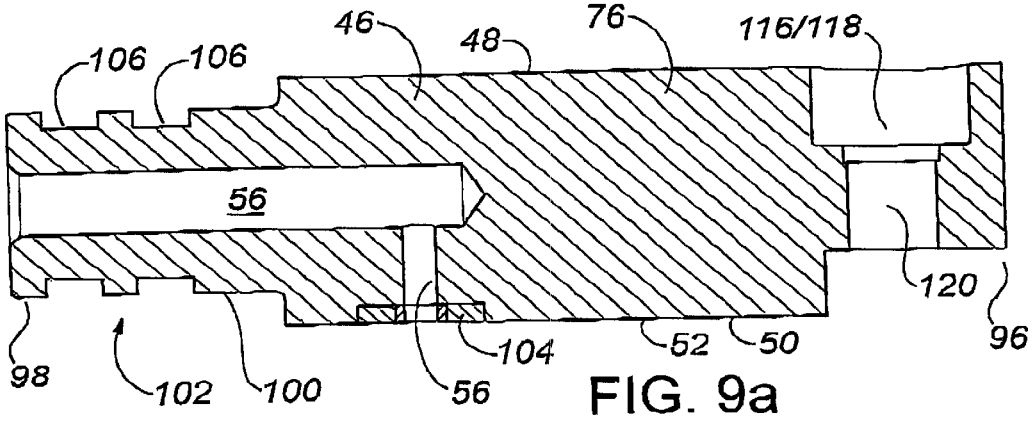
FIG. 9*a* is a longitudinal sectional view of a preferred embodiment of the fluid port insert taken along lines 9—9 of FIG. 7.

In the preferred embodiment, as shown in FIGS. 3 and 4, the body (28) defines a fluid port (108) which extends between the bore (34) of the body (28) and the recess interlocking surface (44). Further, as shown in FIG. 9*a,* the passage (56) defined by the fluid port insert member (76) extends from the proximal end (98) of the fluid port insert member (76), which communicates with the gauge portion (78) of the internal chamber (54), to the fluid port (108). Thus fluid communication is provided between the bore (34) of the body (28) and the gauge (24). Where desirable, one or more O-rings (104) or other seals or sealing devices may be positioned between the insert interlocking surface (52) and the recess interlocking surface (44) at the location of the fluid communication between the passage (56) and the fluid port (108). In the preferred embodiment, this O-ring (104) is comprised of an O-ring face seal.

Alternately, where information or data concerning the parameters or conditions of the borehole is desired or required, the passage (56) may extend from the outer surface (48) of the insert (46) through any portion of the insert (46) permitting the fluid to communicate between the borehole and the gauge (24).

Figure 9B:
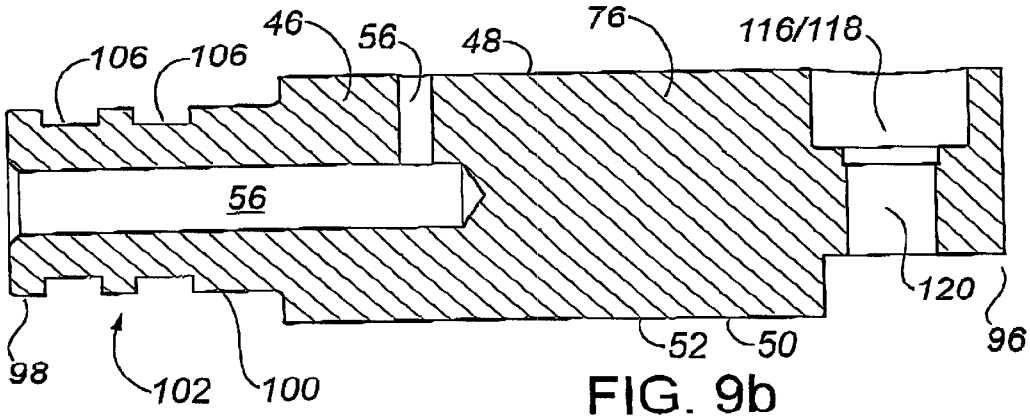
FIG. 9*b* is a longitudinal sectional view of an alternate embodiment of the fluid port insert taken along lines 9—9 of FIG. 7.
Figure 10:
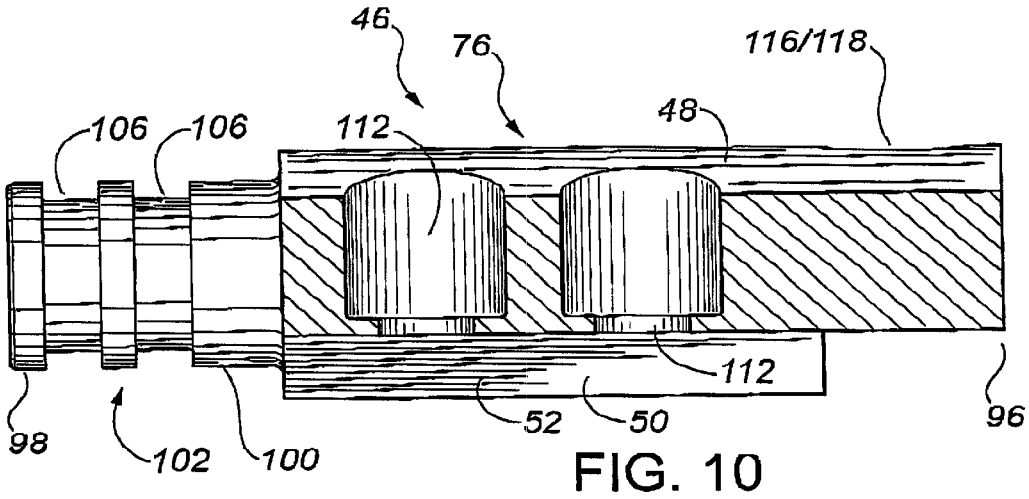
FIG. 10 is a longitudinal sectional view of the fluid port insert taken along lines 10—10 of FIG. 7.
Figure 11:
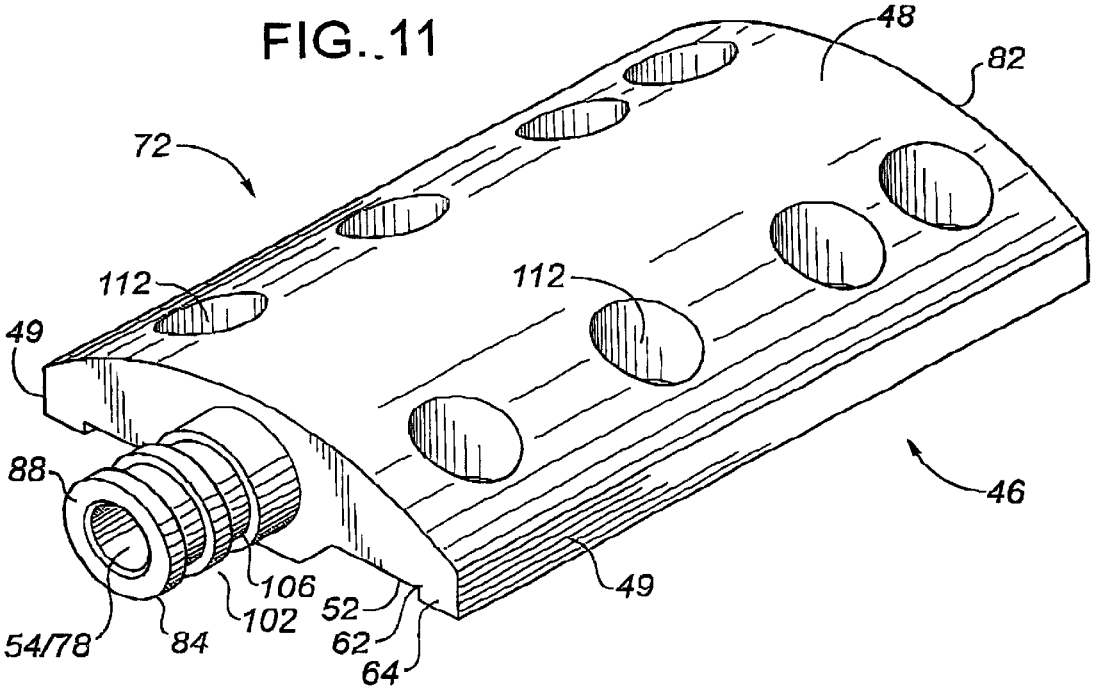
FIG. 11 is a pictorial view of a gauge insert member comprising the insert of the carrier apparatus shown in FIG. 1.
Figure 12:
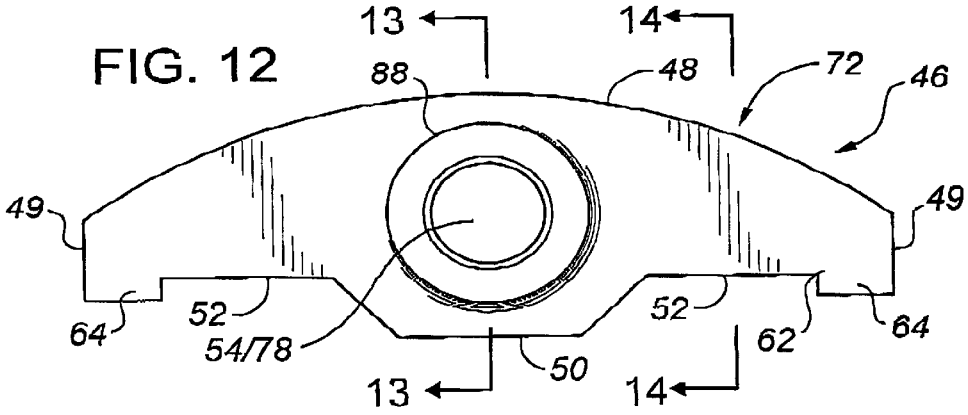
FIG. 12 is a proximal end view of the gauge insert member shown in FIG. 11.
Figure 13:
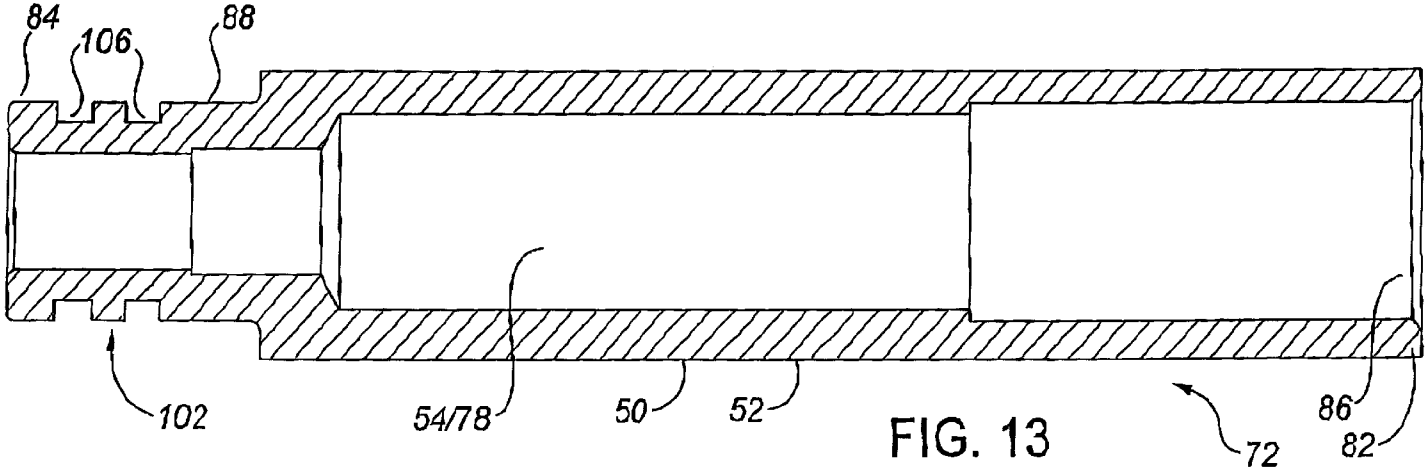
FIG. 13 is a longitudinal sectional view of the gauge insert member taken along lines 13—13 of FIG. 12.
Figure 14:
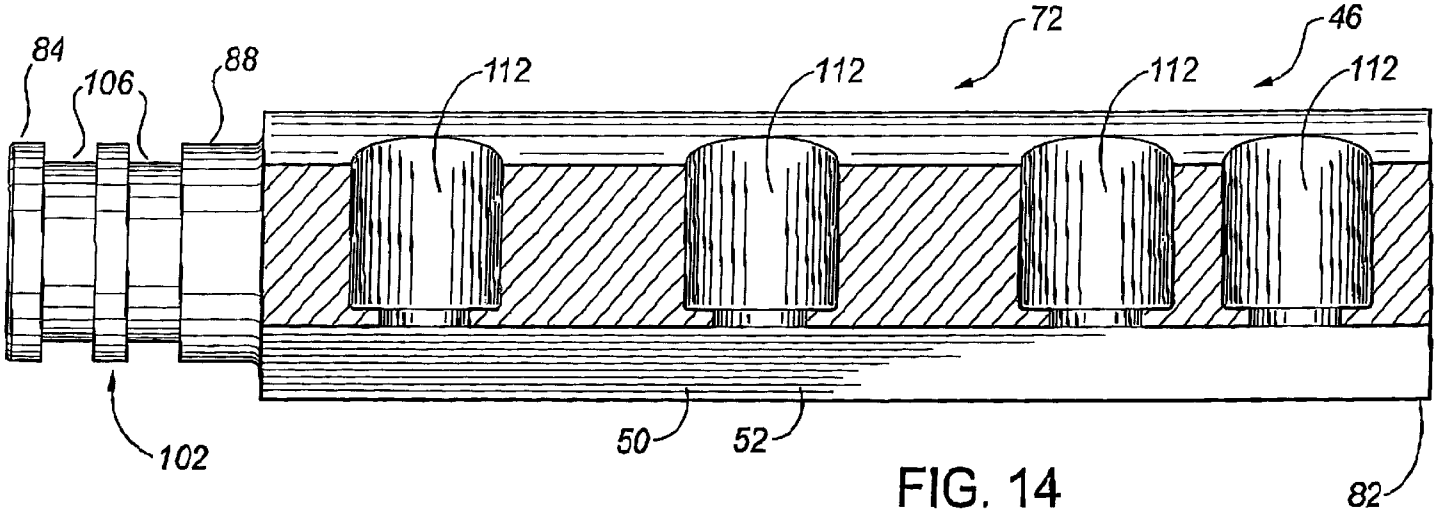
FIG. 14 is a longitudinal sectional view of the gauge insert member taken along lines 14—14 of FIG. 12.
Figure 15:
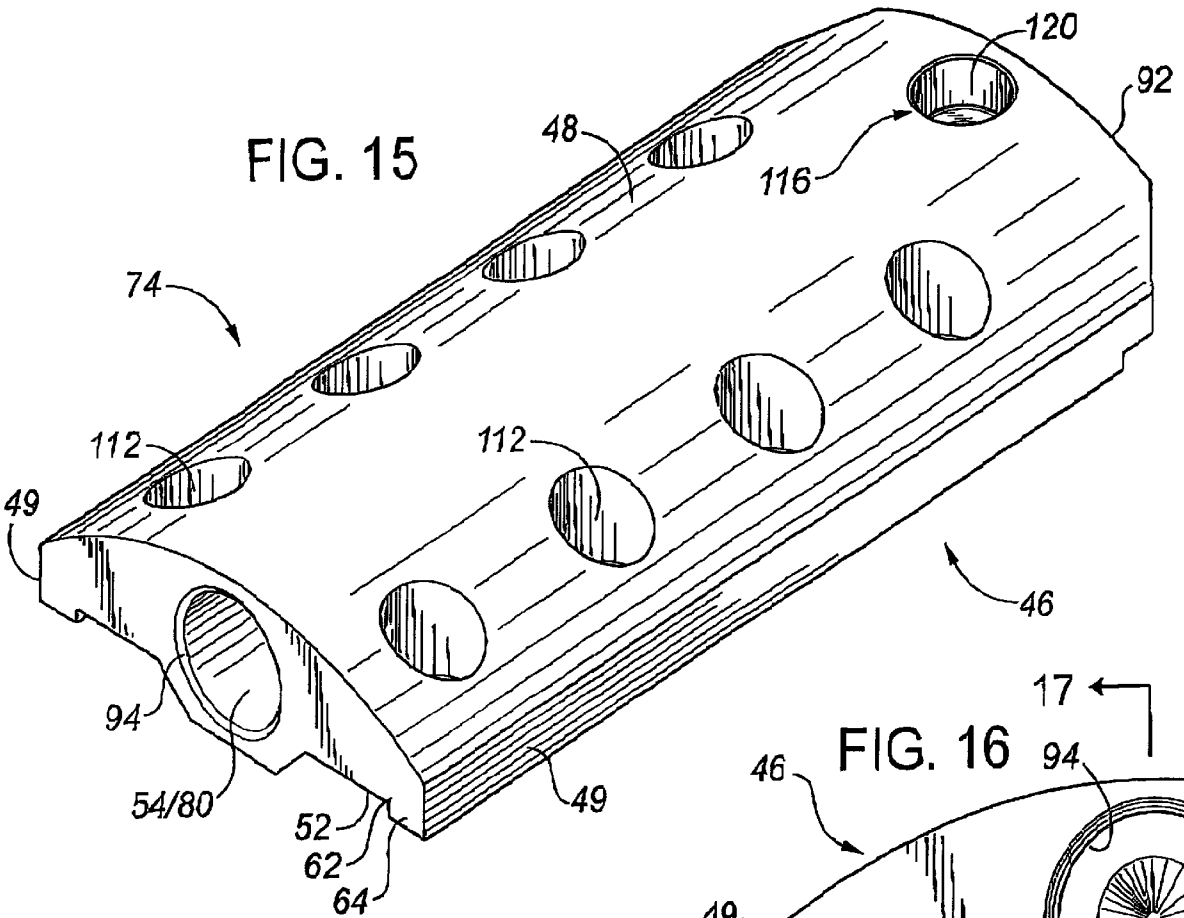
FIG. 15 is a pictorial view of a power source insert member comprising the insert of the carrier apparatus shown in FIG. 1.
Figure 16:
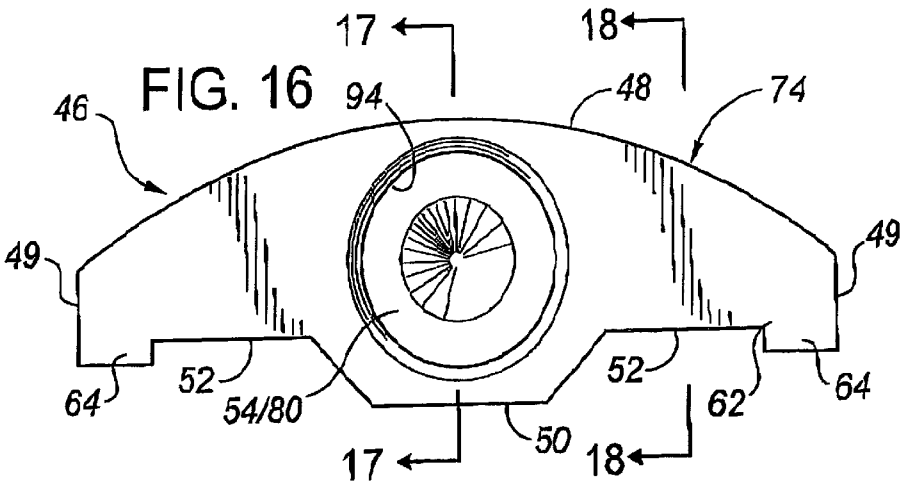
FIG. 16 is a distal end view of the power source insert member shown in FIG. 15.
Figure 17:
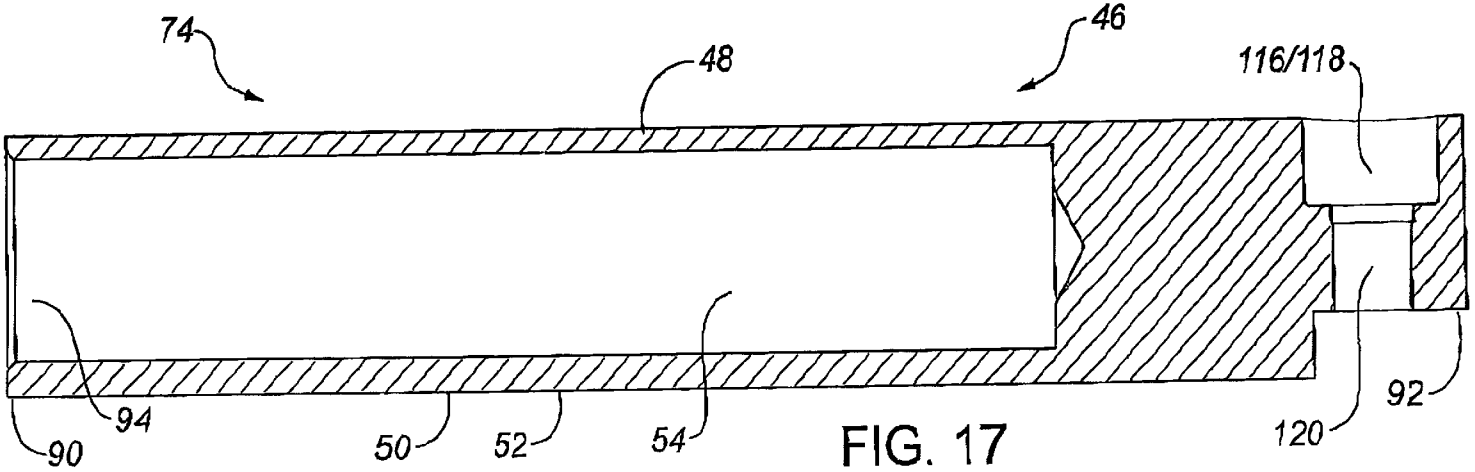
FIG. 17 is a longitudinal sectional view of the power source insert member taken along lines 17—17 of FIG. 16.
Figure 18:
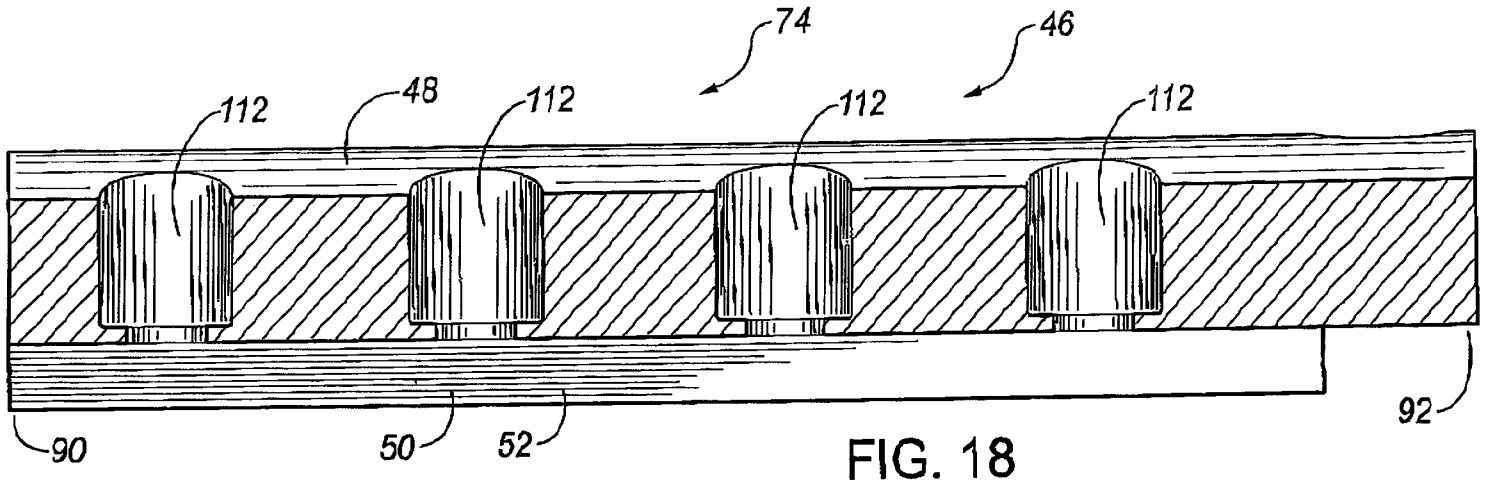
FIG. 18 is a longitudinal sectional view of the power source insert member taken along lines 18—18 of FIG. 16.

Preferably, in this instance, the passage (56) extends through the fluid port insert member (76) of the insert (46). More particularly, as shown in FIG. 9*b,* the passage (56) defined by the fluid port insert member (76) extends from the proximal end (98) of the fluid port insert member (76), which communicates with the gauge portion (78) of the internal chamber (54), to the outer surface (48) of the insert (46). Thus fluid communication is provided between the borehole and the gauge (24).

As indicated above, the insert (46) is mounted with the body (28) such that at least a portion of the insert (46) is receivable within the recess (42) for engagement therewith. The insert (46) may be permanently mounted, attached, affixed or otherwise fastened with the body (28) in any manner and by any mechanism capable of maintaining the engagement between the portion of the insert (46) receivable within the recess (42) and the recess (42) to provide the interlocking interface (58). However, for ease of maintenance, repair and replacement, the insert (46) is preferably releasably mounted, attached, affixed or otherwise fastened with the body (28). Again, the insert (46) may be releasably mounted, attached, affixed or otherwise fastened with the body (28) in any manner and by any mechanism capable of releasably maintaining the engagement between the portion of the insert (46) receivable within the recess (42) and the recess (42) to provide the interlocking interface (58).

Preferably, the apparatus (20) is further comprised of at least one fastener (110) for releasably mounting the insert (46) with the body (28) to maintain the engagement between the insert interlocking surface (52) and the recess interlocking surface (44). In the preferred embodiment, the apparatus (20) is comprised of at least one pair of fasteners (110) and more preferably, a plurality of pairs of fasteners (110). In this instance, each fastener of the pair of fasteners is positioned along opposed sides (49) of the insert (46). Thus, where a plurality of pairs of fasteners (110) are used, the fasteners (110) extend longitudinally along the opposed sides (49) of the insert (46) for a portion of the length of the insert (46). As shown in FIG. 3, preferably, the fasteners (110) extend longitudinally along the opposed sides (49) of the insert (46) for substantially the full length of the insert (46) between the opposed ends (51).

The fasteners (110) may be comprised of one or more of any type of fastener, or a combination of types of fasteners, such as screws or bolts. Further, each fastener (110) preferably extends between the insert interlocking surface (52) and the recess interlocking surface (44). Thus, in the preferred embodiment, the insert (46) defines a plurality of apertures (112) which extend through the insert (46) from the outer surface (48) to the insert interlocking surface (52) for receipt of the fasteners (110) therein. Further, the recess interlocking surface (44) also defines a plurality of apertures (114) which are compatible with the apertures (112) in the insert interlocking surface (52). Thus, in the preferred embodiment, each fastener (110) passes through the aperture (112) in the insert (46) to extend from the insert interlocking surface (52) for receipt in the corresponding aperture (114) in the recess interlocking surface (44). As well, the fastener (110) is preferably countersunk such that the fastener (110) does not extend from or beyond the outer surface (48) of the insert (46) when fastened in place to mount the insert (46) with the body (28).

Finally, when the carrier apparatus (20) is pressurized or mechanically stressed, there may be some permanent distortion of the apparatus (20). Because of the fine tolerances of the apparatus (20), the insert (46) may become stuck to the body (28) or be difficult to remove from the recess (42) when desired for maintenance, repair or replacement. As a result, the carrier apparatus (20) is preferably further comprised of a release mechanism (116) for releasing or facilitating the release of the engagement between the insert (46) and the recess (42), and more particularly, between the insert interlocking surface (52) and the recess interlocking surface (44).

Any mechanism or structure capable of releasing the insert (46) from the recess (42) may be used. However, the release mechanism (116) is preferably comprised of at least one jackscrew, jackbolt or other jacking device (118) extending between the insert interlocking surface (52) and the recess interlocking surface (44) for releasing the engagement therebetween in order to remove the insert (46) from the recess (42). In the preferred embodiment, the release mechanism (116) is comprised of two jackscrews (118), wherein one jackscrew (118) is located or positioned adjacent with or in proximity to the opposed ends (51) of the insert (46).

Further, in the preferred embodiment, the insert (46) defines two apertures (120) which extend through the insert (46) from the outer surface (48) to the insert interlocking surface (52) for receipt of the jackscrews (118) therein. Thus, in the preferred embodiment, each jackscrew (118) passes through the aperture (120) in the insert (46) to extend from the insert interlocking surface (52) for engaging the recess interlocking surface (44). Thus, in use, following the removal of the fasteners (110) from the insert (46), the jackscrews (118) are inserted in the apertures (120) and turned to engage the recess interlocking surface (44) such that the jackscrews (118) effectively pry the insert (46) from the recess (42). Preferably, the jackscrews (118) are the same type of screws as the fasteners (110) so that no additional screws are required. Further, when the carrier apparatus (20) is in use, a short bolt or plug (not shown) may be inserted in the apertures (120) in order to keep the apertures (120) clean and free from debris.

The embodiments of the invention in which an exclusive property or privilege is claimed are defined as follows:

1. A carrier apparatus for connection with a pipe string for use in transporting at least one gauge downhole through a borehole, the apparatus comprising:

(a) a tubular body for connection with the pipe string having a bore for conducting a fluid therethrough and an outer surface, wherein the outer surface has at least one longitudinal recess formed therein, (b) at least one insert defining an internal chamber for receiving a gauge, wherein the insert is mounted with the body such that at least a portion of the insert is receivable within the recess for engagement therewith;

(c) a longitudinally extending interlocking interface comprised of the engagement between the portion of the insert and the recess, wherein the interlocking interface is configured such that the insert inhibits radial expansion of the body adjacent the recess; and (d) at least one passage providing fluid communication between the gauge and the bore of the body or the borehole.

2. The carrier apparatus as claimed in claim 1 wherein the portion of the insert received within the recess is comprised of a longitudinally extending insert interlocking surface, wherein the recess is comprised of a longitudinally extending recess interlocking surface compatible with the insert interlocking surface for engagement therewith and wherein the interlocking interface is comprised of the engagement between the insert interlocking surface and the recess interlocking surface.

3. The carrier apparatus as claimed in claim 2 wherein the recess interlocking surface is configured to define at least one interlocking shoulder and wherein the insert interlocking surface is configured to define at least one compatible interlocking seat such that the interlocking shoulder engages the interlocking seat.

4. The carrier apparatus as claimed in claim 3 wherein the insert interlocking surface is configured to define two interlocking seats extending longitudinally along opposed sides of the insert and wherein the recess interlocking surface is configured to define two interlocking shoulders for receipt in the interlocking seats.

5. The carrier apparatus as claimed in claim 3 wherein the insert interlocking surface is comprised of at least one longitudinally extending flange defining the interlocking seat and wherein the recess interlocking surface is comprised of at least one groove therein defining the interlocking shoulder, wherein the groove is compatible with the flange for engagingly receiving the flange therein.

6. The carrier apparatus as claimed in claim 4 wherein the insert interlocking surface is comprised of two flanges extending longitudinally along opposed sides of the insert defining the interlocking seats and wherein the recess interlocking surface defines two grooves therein defining the interlocking shoulders, wherein the grooves are compatible with the flanges for engagingly receiving the flanges therein.

7. The carrier apparatus as claimed in claim 6 wherein the outer surface of the body defines a circumferential perimeter of the apparatus, wherein the insert has an outer surface and wherein the outer surface of the insert is configured such that the outer surface of the insert is substantially contained within the circumferential perimeter when the insert is received within the recess.

8. The carrier apparatus as claimed in claim 6 wherein the insert is comprised of at least two insert members interconnected to form the insert defining the internal chamber therein.

9. The carrier apparatus as claimed in claim 8 wherein the insert is further comprised of a sealing assembly associated with at least one of the insert members such that the insert members are sealingly interconnected to form the insert.

10. The carrier apparatus as claimed in claim 8 wherein the insert is comprised of a gauge insert member defining a gauge portion of the internal chamber for receiving the gauge therein.

11. The carrier apparatus as claimed in claim 10 wherein the insert is further comprised of a power source insert member defining a power source portion of the internal chamber for receiving a power source for the gauge therein, wherein the gauge insert member and the power source insert member are connected to permit communication between the gauge portion and the power source portion of the internal chamber.

12. The carrier apparatus as claimed in claim 11 wherein the insert is further comprised of a fluid port insert member, wherein the passage is defined by the fluid port insert member and wherein the gauge insert member and the fluid port insert member are connected to permit fluid communication with the gauge through the passage.

13. The carrier apparatus as claimed in claim 12 wherein the insert is further comprised of a sealing assembly associated with the insert members such that the insert members are sealingly interconnected.

14. The carrier apparatus as claimed in claim 13 wherein the body defines a fluid port extending between the bore of the body and the recess interlocking surface and wherein the passage defined by the fluid port insert member extends between the gauge portion of the internal chamber and the fluid port to provide fluid communication between the bore of the body and the gauge.

15. The carrier apparatus as claimed in claim 14 wherein the gauge measures at least one of the pressure, temperature and flow of the fluid conducted through the bore of the body.

16. The carrier apparatus as claimed in claim 13 wherein the passage defined by the fluid port insert member extends between the gauge portion of the internal chamber and the outer surface of the insert to provide fluid communication between the borehole and the gauge.

17. The carrier apparatus as claimed in claim 16 wherein the gauge measures at least one of the pressure, temperature and flow of a fluid contained within the borehole.

18. The carrier apparatus as claimed in claim 6 further comprising at least one fastener for releasably mounting the insert with the body to maintain the engagement between the insert interlocking surface and the recess interlocking surface, wherein the fastener extends between the insert interlocking surface and the recess interlocking surface.

19. The carrier apparatus as claimed in claim 18 further comprising at least one jackscrew extending between the insert interlocking surface and the recess interlocking surface for releasing the engagement between the insert interlocking surface and the recess interlocking surface in order to remove the insert from the recess.

20. The carrier apparatus as claimed in claim 6 further comprising at least one pair of fasteners for releasably mounting the insert with the body to maintain the engagement between the insert interlocking surface and the recess interlocking surface, wherein the pair of fasteners extends between the insert interlocking surface and the recess interlocking surface.

21. The carrier apparatus as claimed in claim 20 wherein each fastener of the pair of fasteners is positioned along opposed sides of the insert.

22. The carrier apparatus as claimed in claim 21 further comprising at least one jackscrew extending between the insert interlocking surface and the recess interlocking surface for releasing the engagement between the insert interlocking surface and the recess interlocking surface in order to remove the insert from the recess.

23. The carrier apparatus as claimed in claim 6 wherein the pipe string is comprised of a tubing string and wherein the body is adapted for connection with the tubing string to provide continuous fluid communication with the tubing string through the bore of the body.

24. The carrier apparatus as claimed in claim 6 wherein the outer surface of the body has greater than one longitudinal recess formed therein for receiving the insert such that greater than one gauge may be transported by the apparatus and wherein the recesses are longitudinally spaced along a length of the body.

* * * * *